US005574433A

United States Patent [19]

Bahcall

[11] Patent Number: 5,574,433

[45] Date of Patent: Nov. 12, 1996

[54] WATCH ALARM

[75] Inventor: James Bahcall, Mequon, Wis.

[73] Assignee: ArmAlarm Incorporated, Mequon, Wis.

[21] Appl. No.: 627,261

[22] Filed: Apr. 3, 1996

[51] Int. Cl.[6] ..... G08B 15/00

[52] U.S. Cl. ..... 340/574; 340/693; 368/10

[58] Field of Search ..... 340/574, 693; 368/12, 10

[56] References Cited

U.S. PATENT DOCUMENTS

| | | | |
|---|---|---|---|
| 4,160,176 | 7/1979 | Takahashi | 307/362 |
| 4,232,383 | 11/1980 | Chihara | 368/66 |
| 4,236,237 | 11/1980 | Ichikawa | 368/66 |
| 4,591,836 | 5/1986 | Feigenblatt, Jr. et al. | 340/574 |
| 4,694,284 | 9/1987 | Leveille et al. | 340/574 |
| 4,806,911 | 2/1989 | Petri | 200/61 |
| 5,005,002 | 4/1991 | Halperin | 340/574 |
| 5,006,832 | 4/1991 | Beaudry | 340/574 |
| 5,235,322 | 8/1993 | Obysovsky et al. | 340/574 |
| 5,258,746 | 11/1993 | Leitten et al. | 340/693 |
| 5,471,199 | 11/1995 | Yuan | 340/574 |
| 5,521,582 | 5/1996 | Kingston | 368/12 |

*Primary Examiner*—Glen Swann
*Attorney, Agent, or Firm*—Quarles & Brady

[57] ABSTRACT

A personal security alarm is combined with a wristwatch to be readily accessible on a user's wrist in an emergency situation. An exposed activation button has a large surface to be easily activated by a person's finger or face; a reset button is hidden on the underside of the device to require removal of a buckle fastener before resetting can be done.

12 Claims, 1 Drawing Sheet

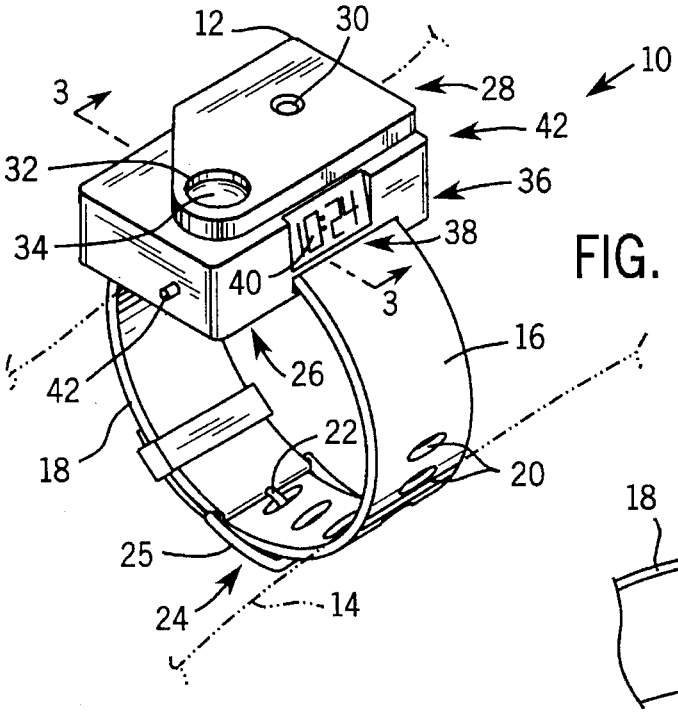
FIG. 1
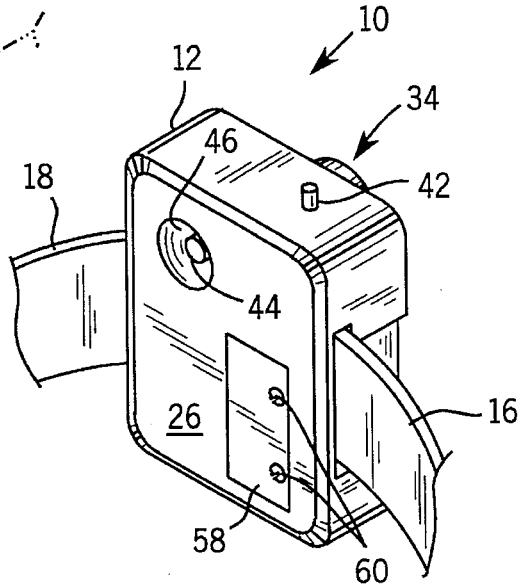
FIG. 2
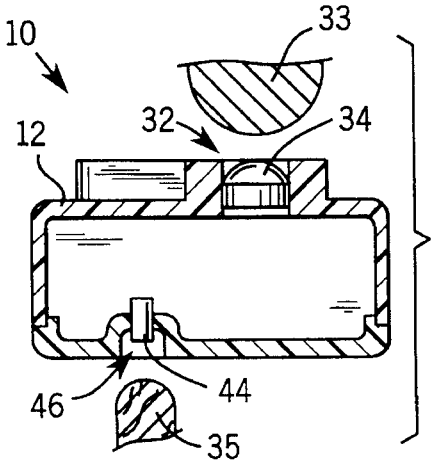
FIG. 3
FIG. 4
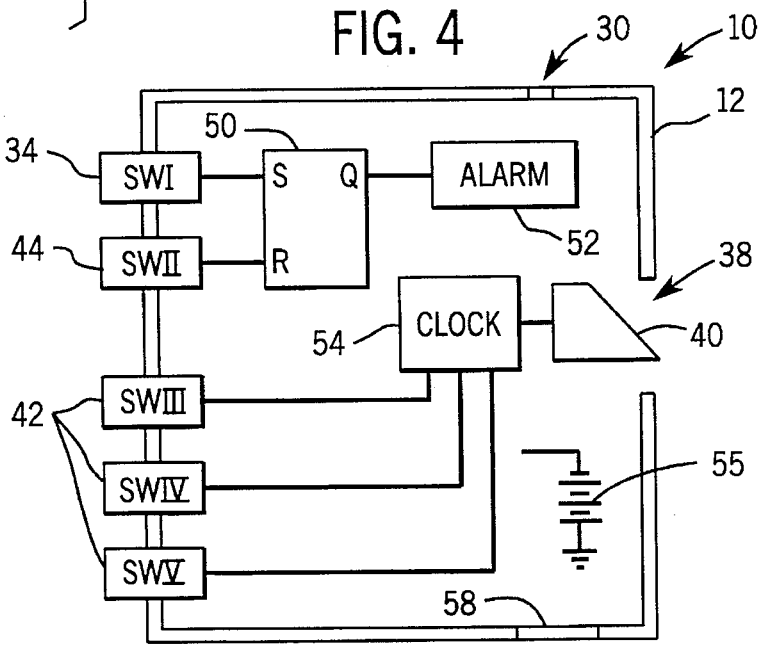

WATCH ALARM

FIELD OF THE INVENTION

The present invention relates to personal security alarms that, when activated by a user, produce a loud alarm signal, and in particular to such a security device adapted to be worn on the wrist in lieu of a wristwatch.

BACKGROUND OF THE INVENTION

Personal security devices that produce a loud alarm signal may be used to discourage would-be attackers. Such security devices may employ an electronic circuit activated by the removal of a pin causing completion of an electrical path activating an audio transducer such as a buzzer or the like. The pin, which may be relatively easy to remove, is difficult to reinsert preventing the alarm from being easily deactivated by the attacker.

For such alarm units to be effective, they must be carried to be accessible at a moment's notice. As a consequence, the alarm units may be activated accidentally. The pins, which can be attached to a strap so that they may be easily located in an emergency, are particularly susceptible to catching on objects which pull them free. An accidental activation, for example in an elevator or office, can be a traumatic experience and may result in the user foregoing the protection offered by the alarm system altogether. Making the alarm unit more difficult to activate may compromise its value in an emergency situation.

Remembering to carry the alarm on a regular basis can be difficult, and holding the alarm unit in one's hands so that it is immediately available is burdensome and awkward.

SUMMARY OF THE INVENTION

The present invention incorporates a personal alarm into a wristwatch that may be worn on the wrist to be easily located and activated by the user. A single button on the top of the wristwatch turns on the alarm, but turning it off requires the pressing of a button positioned between the alarm unit and the user's wrist. This deactivating button is difficult for an attacker to reach when the alarm is fastened to the user's wrist.

Specifically, the device includes a wrist strap having a fastener holding the first and second ends of the wrist strap together about a person's wrist in a fastened state and allowing the first and second ends of the wrist strap to be separated for removal of the wrist strap from the person's wrist in a loosened state. A housing attached to the wrist strap has an exposed side accessible by the user and a covered side blocked by the person's wrist when the wrist strap is in the fastened state around a person's wrist. The housing holds an electronic alarm circuit that has a first and second electrical switch, the first electrical switch activating the alarm circuit and the second switch deactivating the alarm circuit. The first electrical switch has a switch operator extending from the exposed side and the second electrical switch has a switch operator extending from the covered side.

Thus, it is one object of the invention to provide a personal security alarm that may be easily deactivated by the user, but that is not easily deactivated by a would-be attacker. Positioning the deactivation button beneath the housing next to the user's wrist renders access to the button by third persons extremely difficult, both because the button is blocked by the user's wrist both physically and visually and because the user's wrist will normally be a moving target.

It is another object of the invention to provide a personal security device that is easy to activate by a user and yet resistant to accidental activation. The button to activate the alarm may be relatively small, but because it is fixed in location with respect to the user's wrist it is easily accessible by the user. The button may be positioned within a depression preventing accidental activation by blunt objects but permitting activation by a finger or by the user's chin or nose.

The wrist strap may use, as a fastener, a buckle type fastening mechanism in which a tongue engages holes in one of the straps as retained in a buckle frame.

Thus, it is another object of the invention to provide a familiar means of fastening a personal alarm to a person's wrist that may be easily removed by the person, but that is relatively difficult to remove by a would-be attacker. The buckle mechanism naturally tightens upon tension, such as would be caused by pulling the alarm unit and requires a movement of the two straps contracting the wrist strap toward each other for removal of the tongue from the hole, an operation difficult to perform without cooperation by the wearer.

The alarm may incorporate a clock and the housing may include a window through which a clock face may be displayed.

Thus, it is another object of the invention to provide an alarm unit that may be used in place of a normal wristwatch and thus, by being integrated into the person's normal personal accessories, is always available in an emergency situation.

The housing may include one or more buttons which also protrude from an exposed side.

It is yet another object of the invention to provide an array of buttons on the exposed surface of the housing to distract an attacker from the second button which actually controls the resetting of the alarm feature.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference must be made therefore to the claims herein for interpreting the scope of the invention.

BRIEF DESCRIPTION OF THE DRAWINGS

FIG. 1 is a perspective view of the alarm unit in a fastened state about a user's wrist showing the transducer sound hole positioned adjacent to the activation button on an exposed face of the housing and showing a side-mounted watch face tipped upward for viewing by the user;

FIG. 2 is a partial perspective view of the underside of the alarm unit of FIG. 1 as is normally adjacent to the user's wrist showing the deactivation button positioned within a recess and the battery compartment positioned on that covered side;

FIG. 3 is a partial cross-sectional view taken along line 3—3 of FIG. 1 showing the position of the switch operators with respect to the surfaces of the housing of the alarm unit, such as allow the switch operators to resists accidental activation; and FIG. 4 is a block diagram of the circuitry of the security device showing the connection of switches to associated functional modules within the security device.

DETAILED DESCRIPTION OF THE PREFERRED EMBODIMENT

Referring now to FIG. 1, the alarm unit 10 of the present invention includes a generally rectangular housing 12 held against a wrist 14 of a user by means of wrist straps 16 and 18.

Wrist strap 16 includes a number of belt holes 20, one of which may be received by a tongue 22 of a buckle type-fastener 24 when strap 16 is threaded through a buckle frame 25 of the buckle 24. The buckle 24 is attached to wrist strap 18 so that wrist straps 18 and 16 can be drawn tightly about the user's wrist 14 in a manner similar to a normal wrist-watch band.

The ends of wrist straps 18 and 16 not fastened together by the buckle 24 are attached to the housing 12 to be substantially flush with a covered surface 26 of the housing, so-called because it is normally covered by the wrist 14 of the user. Thus, when straps 16 and 18 are tightened about the wrist 14 of the user, the covered surface 26 is drawn flat against the upper portion of the user's arm.

A top exposed surface 28 of the housing 12 includes two apertures, a first sound port 30 allowing the transmission of an alarm signal from the interior of the housing 12, as will be described, and a second button well 32 holding a slidable switch operator 34 of a first switch, also to be described.

A first side 36 of the housing 12, extending upward from the user's wrist 14 and facing the user when the user's arm is bent, has a window 38 exposing a watch face 40 of a conventional seven-segment LCD display. Watch control buttons 42 (only one watch control button 42 is visible in FIG. 1) extend from opposed sidewalls of the housing 12 on either side of wall 36 and provide for the standard mode, set, and display controls of clock circuitry such as is well-known in the art.

Referring also to FIG. 2, the covered surface 26 of the housing 12 holds a second switch operator 44 positioned within a cavity 46 in the covered surface 26.

Referring now also to FIG. 3, switch operators 34 and 44, in an unactuated position, are protected against accidental activation by the surrounding wall of well 32 for switch operator 34 and the rim of the depression 46 for switch operator 44.

With regard to switch operator 34, connected to a first switch that activates the alarm, a relatively blunt surface, such as the flat of a person's hand or a wall is stopped by the wall of well 32. On the other hand, operator 34 can be activated, for instance, by pressure from an object 33 having a radius of curvature less than approximately one-half inch, such as a person's finger or a person's nose or chin, for example, if only one hand is free. Thus, switch operator 34, even though sunken, is relatively large to allow activation by a number of means. The location of switch operator 34 is also easily located by its positioning near a corner of the housing 12 and by a bevel cut in the upper surface of the housing 12 which provides an immediate tactile indication of the orientation of the alarm unit 10 and the location of the switch operator 34.

In contrast, switch operator 44 for the switch number 2 which deactivates the alarm, is much smaller in area and cannot easily be activated except by a person's finger 35 as a result of the small radius depression 46 which surrounds button 44. Thus, only a conscious and intentional resetting of the alarm unit 10 is allowed.

Switch operator 34 is generally larger than switch operator 44 in keeping with the desire that activation of the alarm be easier than deactivation of the alarm.

Referring now to FIG. 4, the switch operator 34 of the first switch, when depressed, provides a signal to a flip-flop circuit 50 of a type well known in the art. The flip-flop 50 has an output Q that is "set" by pressing switch operator 34 and "reset" by a pressing of switch operator 44. When set, the output of the flip-flop 50 activates an alarm transducer 52 which may be a piezoelectric electrical element well known in the art.

The output of the flip-flop 50 remains in the set state once switch operator 34 is pressed even after switch operator 34 is released and thereafter only changes state to a reset state when switch operator 44 is pressed. When the output of the flip-flop 50 is in the reset state it remains there until the switch operator 34 is again pressed. When neither switch operator 34 nor 44 is pressed, the flip-flop 50 remains in its current state.

The additional buttons 42 are connected to a clock circuit 54, which drives the LCD display 40, providing a full function wristwatch capability to the user. The display 40 is canted at approximately 30° from vertical (with respect to the plane established by the covered surface 26) so as to provide easy viewing by the user from its position at the side 36 of the housing 12 and to permit the upper surface 28 of the alarm unit 10 to be devoted to the transducer 52 and the switch operator 34, both which may then be made larger for effective operation.

Referring again to FIGS. 2 and 4, a battery 55 provides power for both the alarm circuit of flip-flop 50 and transducer 52 and the clock circuit 54 and display 40 and is held within a battery compartment closed by a cover 58, the latter which is held in place by two Phillips head screws 60 so as to resist opening under force. The screws provide a simple solution to preventing deactivation of the alarm without determining the location or operation of the reset switch operator 44 by removing the battery 55 or striking the unit to dislodge the battery 55. The cover 58 is also blocked by the user's wrist 14 when the alarm unit 10 is in the fastened state around the wrist 14 of the user adding additional security against removal of the battery 55.

In operation the user activates the alarm by pressing switch operator 34 and the alarm continues to sound until the user releases the buckle 24 and removes the alarm unit 10 pressing switch operator 44. It will be apparent that no special tool is required for resetting the alarm unit 10, such tool as may be misplaced.

The above description has been that of a preferred embodiment of the present invention. It will occur to those that practice the art that many modifications may be made without departing from the spirit and scope of the invention. In order to apprise the public of the various embodiments that may fall within the scope of the invention, the following claims are made.

I claim:

1. A personal security device comprising:

a wrist strap;

a fastener holding a first and second end of the wrist strap together about a person's wrist in a fastened state and allowing the first and second end of the wrist strap to be separated for removal of the wrist strap from the person's wrist in a loosened state;

a housing attached to the wrist strap to have an exposed side exposed to access by the user and a covered side covered by the persons' wrist when the wrist strap is in the fastened state around a person's wrist; and an electronic alarm circuit having a first and second electrical switch, the first electrical switch activating the alarm circuit and the second switch deactivating the alarm circuit;

wherein the first electrical switch has an switch operator extending from the exposed side and the second electrical switch has an switch operator extending from the covered side.

2. The personal security device as claimed in claim 1 including an electronic clock having a display visible through the exposed side.

3. The personal security device as claimed in claim 1 wherein the switch operator for the second electrical switch is recessed below an outer surface of the covered side.

4. The personal security device as claimed in claim 1 wherein the fastener is a buckle.

5. The personal security device as claimed in claim 1 wherein the first switch operator is larger than the second switch operator.

6. The personal security device as claimed in claim 1 wherein the switch operator of the first switch is recessed beneath an outer surface of the exposed side so as to be activated only by a surface having a radius of curvature of less than one inch.

7. The personal security device as claimed in claim 1 having additional switch operators extending from the exposed side that do not reset the alarm.

8. The personal security device as claimed in claim 7 including an electronic clock having a display visible through the exposed side wherein the additional switch operators control the electronic clock.

9. The personal security device as claimed in claim 8 wherein the display is visible through a side surface of the exposed side of the housing extending outward for a user's wrist when the housing is in the fastened state about a user's wrist.

10. The personal security device as claimed in claim 8 wherein the display is canted with respect to the surface of the user's wrist contacting the housing when the housing is in the fastened state about a user's wrist.

11. The personal security device as claimed in claim 1 including a battery housing sized to hold a battery powering the alarm circuitry, the housing having a door positioned on the covered side of the housing.

12. The personal security device as claimed in claim 11 wherein the door is held closed by screws.

* * * * *